United States Patent [19]

Eichler

[11] 4,310,938

[45] Jan. 19, 1982

[54] SWIMMING SHOE FOR BREAST STROKE

[76] Inventor: Dieter Eichler, Wessobrunner Str. 25, 8000 Munich 70, Fed. Rep. of Germany

[21] Appl. No.: 100,944

[22] Filed: Dec. 6, 1979

Related U.S. Application Data

[63] Continuation-in-part of Ser. No. 881,700, Feb. 27, 1978, abandoned.

[51] Int. Cl.[3] ..... A63B 31/10

[52] U.S. Cl. ..... 9/309

[58] Field of Search ..... 9/301, 303, 304, 305, 9/306, 309, 310 R, 310 J; 16/72, 73, 74, 150, DIG. 13

[56] References Cited

U.S. PATENT DOCUMENTS

| | | | |
|---|---|---|---|
| 96,002 | 10/1869 | Harpster | 16/73 |
| 1,508,524 | 9/1924 | Olson | 16/72 |
| 3,447,199 | 6/1969 | Trimble | 16/150 |
| 3,671,987 | 6/1972 | Mayor | 9/309 |
| 3,867,734 | 2/1975 | Courageux | 9/309 |

FOREIGN PATENT DOCUMENTS

| | | | |
|---|---|---|---|
| 32850 | 5/1908 | Austria | 9/305 |
| 460511 | 5/1928 | Fed. Rep. of Germany | 9/304 |
| 328519 | 5/1930 | United Kingdom | 9/304 |

*Primary Examiner*—Trygve M. Blix
*Assistant Examiner*—John C. Paul
*Attorney, Agent, or Firm*—W. G. Fasse; D. F. Gould

[57] ABSTRACT

The present swimming shoe is intended for use in connection with breast stroke swimming as opposed to other types of swim strokes. For this purpose the body of the present swimming shoe has a cavity for receiving a swimmer's foot and a bottom or sole as well as a shoe upper. Two thrust or propulsion flaps or flippers are hinged to the shoe body in such a manner that a pulling movement of the swimmer's legs substantially reduces the surface area of the swimming shoe, whereas a thrust or propulsion movement of the swimmer's legs increases the "thrust surface area" in an optimal manner. To this end one propulsion flap is hinged to a longitudinal edge of the sole whereas another propulsion flap is hinged to the longitudinal side of the shoe upper, preferably diagonally opposite the first flap or flipper.

9 Claims, 5 Drawing Figures

SWIMMING SHOE FOR BREAST STROKE

CROSS REFERENCE TO RELATED APPLICATIONS

The present patent application is a Continuation-In-Part patent application of my copending patent application U.S. Ser. No. 881,700; filed on Feb. 27, 1978, now abandoned.

BACKGROUND OF THE INVENTION

The present invention relates to swimming shoes intended for breast stroke swimming. Each shoe is provided with two non-symmetrically arranged propulsion surfaces. Such swim shoes are intended to facilitate the forward motion of a swimmer in the water. Simultaneously the shoes shall enable the swimmer to walk on land and also in the water.

German Patent Publication (DAS) No. 1,001,167 describes a swimming shoe which is provided with two flippers. It is also known to provide swim shoes with symmetrically arranged flaps or flippers, whereby these flaps substantially extend in the plane of the bottom wall or sole of the swim shoe when the flaps are fully extended, thereby providing an opening angle of approximately 180°.

U.S. Pat. No. 1,603,616 discloses a swimming appliance in which a paddle type of flipper is hinged to the sole of a boot type swimming shoe. The paddle may be placed into an upright position, thereby enabling the swimmer to walk, whereby the paddle is held in the upright position by a spring hook. The spring hook is adjustable to limit the angular movement of the paddle.

German Patent Publication (DOS) No. 2,009,381 discloses a swimming shoe wherein the flipper forms an integral part of the shoe proper, whereby walking with this type of flipper is substantially impeded.

German Utility Model Application No. 385,699 of May 30, 1964 discloses a flipper type of sandal especially intended for water treading. The hinge is such that a lifting of the legs will cause the paddle type flipper to fold downwardly, whereas a thrusting of the leg downwardly will raise the flipper, thereby increasing the surface area of the sandal.

All types of prior art swim shoes do not provide the desired substantial improvement of the breast stroke type of swimming speed because the sole of these shoes do not extend continuously at a right angle to the direction of the main thrust when the swimmer moves his legs in the breast stroke type of leg movement. Thus, the respective propulsion force is not efficiently utilized because an undesirably large proportion of the propulsion force is diverted, whereby the legs of the swimmer are forced downwardly which further decreases the efficiency of the breast stroke type of movement by increasing the surface area of the swimmer's body relative to the feed advance direction in the water. Thus, prior art swim shoes have largely been ineffective for the breast stroke type of swimming and most prior art swim shoes were primarily designed for the crawl type of swim stroke.

Further, it is intended that the present swim shoe shall enable the user to walk and stand without the need for any manual adjustments. This is not possible with prior art swim shoes if it is simultaneously intended to optomize the effect of the frog kick thrust.

OBJECTS OF THE INVENTION

In view of the above, it is the aim of the invention to achieve the following objects singly or in combination:

to provide a swim shoe designed for use in the breast stroke type of swimming and having increased propulsion surfaces arranged and shaped in such a manner that the feed advance or propulsion power is used in an optimal manner in response to a symmetric leg movement of the swimmer;

to provide a swim shoe enabling the user to stand and walk on land and in water without any adjustment; while nevertheless permitting exposing a large propulsion effective plane of each swim shoe to the water resistance when the swimmer moves the legs in a frog kick or breast stroke;

to construct the swim shoe in such a manner that swimming faults such as a shearing leg stroke are prevented or corrected;

to arrange two flippers or propulsion flaps in such a manner relative to the shoe that the water flow will minimize the surface area when the swimmer pulls his legs in a breast stroke type of movement and that the surface area is optimized during the thrust movement of the legs, whereby the propulsion effective plane extends substantially perpendicularly to the direction of the thrust developed by a frog kick; and to construct the flippers proper so that they form a cavity or cavities opening in the direction of the thrust of a frog kick.

SUMMARY OF THE INVENTION

According to the invention there is provided a swimming shoe for use in breast stroke swimming having a shoe body including upper wall means, bottom wall means, inner side wall means, and outer side wall means, said wall means being operatively interconnected to form a foot receiving cavity, first propulsion flap means are operatively secured by first hinge means to the bottom wall means alongside one of said side wall means. Second propulsion flap means are operatively secured by second hinge means to the other of said side walls alongside the upper wall means. One of the two flaps forms a sole flipper which is secured to the outer longitudinal edge of the sole, whereas the other flap is an inner flipper secured to the upper edge substantially diagonally opposite the sole flipper. The sole flipper and the sole proper may form an angle within the range of 90° to 100°. The inner or side flipper forms an angle of about 100° to 150° with the substantially vertically extending inner side wall of the swim shoe.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE PRESENT INVENTION

Figure 1:
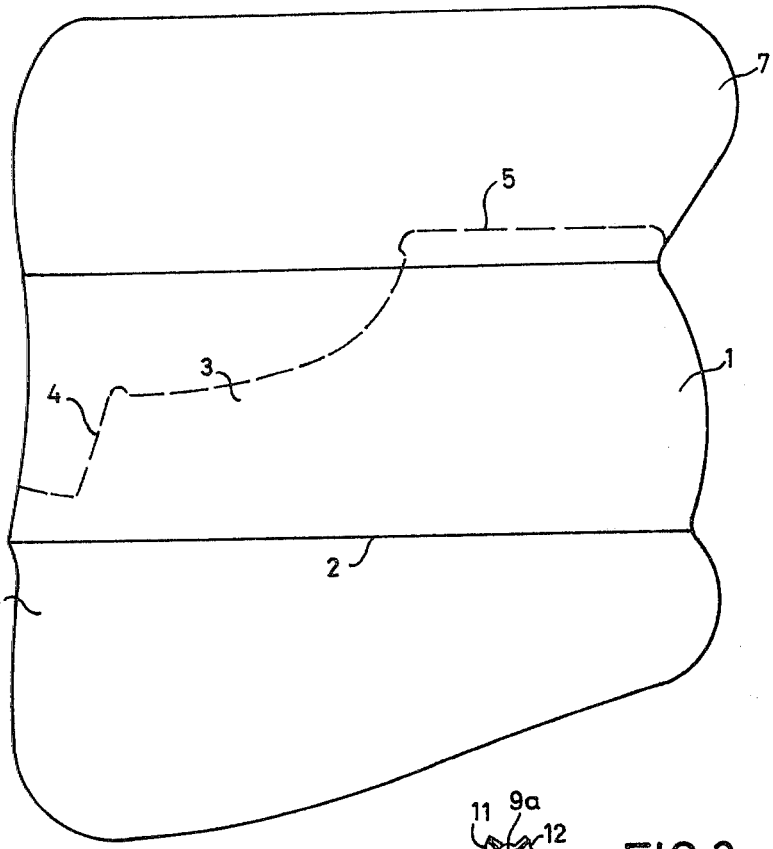
FIG. 1 is a side view of the left side of a swim shoe according to the invention, whereby the flippers are shown in the fully extended or flipped out position.

Referring to FIG. 1 there is shown a side view of a swimming shoe 1 according to the invention comprising a sole flipper 6 and a side flipper 7. The shoe body proper has right and left side walls and a shoe upper 3 as well as a sole 2. The front portion of the shoe may be provided with a cut-out 4 for the swimmer's toes. An opening 5 provides access into the cavity formed by the body of the shoe for the swimmer's foot.

Figure 5:
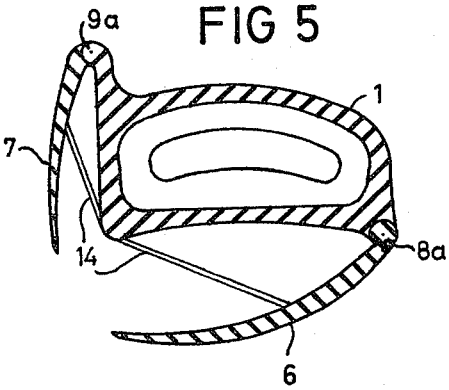
FIG. 5 shows a sectional view similar to that of FIG. 3, however, of a modified show provided with elastic connectors for limiting the opening angle of the flippers.

Both flippers or propulsion flaps 6 and 7 have a predetermined shape which has been found to provide an optimal utilization of the thrust of a swim stroke. Further, the flaps are arranged in such a manner that an upward pull will make the flaps to fold inwardly. Thus, flap 7 will fold itself to extend substantially alongside the side wall of the shoe and flap 6 will be positioned substantially below the sole 2 as best seen in FIGS. 3 and 5.

Figure 2:
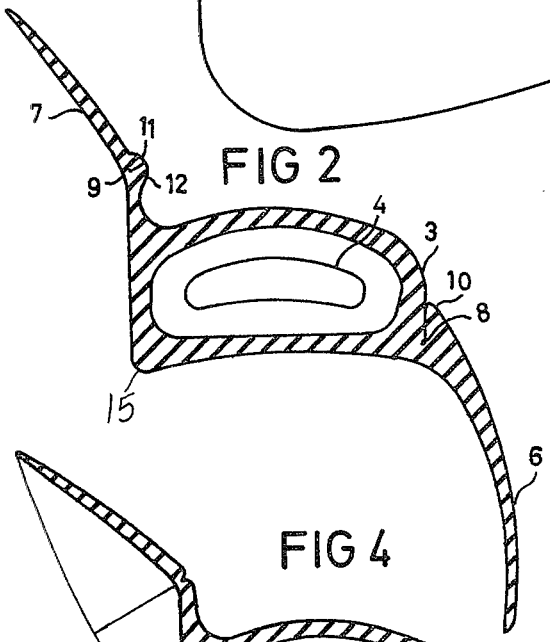
FIG. 2 is a sectional view through a swim shoe as shown in FIG. 1 illustrating a right shoe, whereby the propulsion effective plane extends substantially through the upper left hand corner of the upper flipper and through the lower right hand corner of the lower flipper and the direction of thrust of a frog kick extends substantially perpendicularly to said plane.

FIG. 1 shows the inside of the shoe 1, that is, a view in the direction of the plane of the drawing in FIG. 2 and looking toward the shoe. The sole flipper 6 has a shape substantially corresponding to the mirror image of the sole 2. The flippers 6 and 7 are both in the fully extended condition.

FIG. 2 shows the sectional view through a swim shoe according to the invention as shown in FIG. 1 with the flippers 6 and 7 hinged to the body of the shoe through wall sections of reduced cross sectional thickness forming the hinges. Thus, the sole flipper 6 is secured to the outer side wall of the shoe body 1 by means of a hinge 8. An extension 10 of the flipper 6 adjacent to the hinge 8 and running alongside to the hinge 8 forms a stop member which limits the outward flapping movement of the flipper 6. The position of the hinging angle limiting extension 10 is such that the hinging angle is within the range of 90° to 120°, whereby any hinging beyond such a hinging angle is substantially prevented. Similarly, the flipper 7 is secured to the inner side wall of the shoe by means of a hinge 9 and the flipper 7 is provided with a hinging angle stop member 11. The inner side wall is also provided with a hinging angle stop member 12. The two members 11 and 12 are positioned relative to each other in such a manner that the maximum opening angle of the flipper 7 relative to the plane of the inner side wall is within the range of 100° to 150°. The limiting of the hinging angle has the advantage that the flippers will take up the position which provides the optimal surface for utilizing the force of the breast swim stroke. In the shown, open position the flippers 6 and 7 define the above mentioned propulsion effective plane which optimizes the effect of the frog kick without interfering with the walking when the flippers are in the position shown in FIG. 3.

Figure 3:
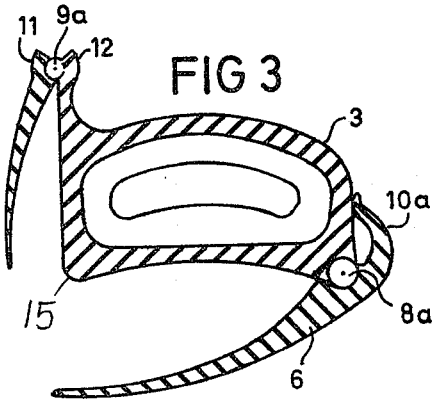
FIG. 3 is a sectional view similar to that of FIG. 2, but illustrating a modified embodiment with different flipper hinges, wherein the propulsion effective plane and the direction of thrust extend substantially in the same manner as in FIG. 2.

FIG. 3 shows a modification of the present invention, wherein the flipper 7 is secured by a hinge pin 9*a* to the inner side wall of the shoe body along the inner upper edge where the side wall slightly extends above the upper wall 3 of the shoe body. The angle limiting elements 11 and 12 are of the same type as shown in FIG. 2. The flipper 6 is secured to the sole at the outer edge thereof where the sole meets the outer side wall of the shoe body, by means of a hinge pin 8*a*. Further, the flipper 6 is provided with a curved extension element 10*a* which has a free edge bearing against the side wall of the shoe body. The element 10*a* is sufficiently spring elastic, yet simultaneously sufficiently rigid to provide a spring biassing of the flipper 6 into the position shown in FIG. 3, wherein the flipper 6 extends substantially in parallel to the sole 2 of the shoe body. In the position of the flippers shown in FIG. 3 the user may walk on land or in water. The flipper extension element 10*a* is sufficiently elastic to not interfere with the breast swim stroke in which the flipper is extended as shown in FIG. 2. Further, the position of the flippers shown in FIG. 3 is accomplished by the swimmer pulling up the legs, whereby the biassing force of the element 10*a* facilitates the inward folding of the flipper 6. Preferably the extension 10*a* will run along the entire length of the shoe side wall or it may be provided in the form of one or several fingers extending from the flipper 6.

Figure 4:
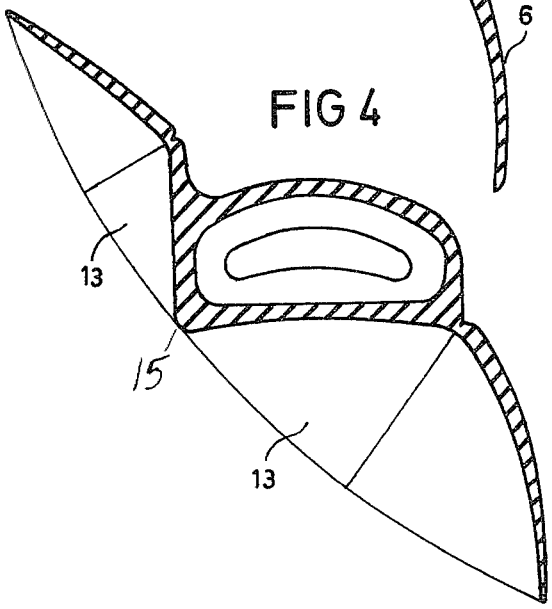
FIG. 4 is a sectional view similar to that of FIG. 2, however, showing a modified version with foldable webs interconnecting the flippers and the shoe body proper.

FIG. 4 illustrates an embodiment quite similar to that of FIG. 2. However, the side walls of the shoe body and the respective adjacent flippers are interconnected by swim webs 13. The webs are also made of an elastic rubber material to pull the flippers against the shoe unless the shoe is subject to the forces resulting from a breast swim stroke, whereby the flippers are extended and the swim webs 13 spread as shown in FIG. 4. The swim webs 13 simultaneously function as limiting elements of the hinging angle, whereby the respective stop elements of FIG. 2 or 3 are not necessary. Simultaneously the swim webs 13 contribute to a maximum utilization of the swim stroke forces by preventing any flow forces to evade laterally, since the webs 13 with the flippers 6, 7 form cavities which open substantially in the direction of a frog kick thrust.

FIG. 5 shows an embodiment wherein the flippers 6 and 7 are hinged to the shoe by hinging elements 8*a* and 9*a*, such as pins. In addition, the flippers 6 and 7 are interconnected with the inner edge of the shoe body proper where the sole and the inner side wall meet. The interconnection is accomplished by spring elastic elements 14 which limit the hinge angle when the flippers 6 and 7 are extended in response to a propulsion stroke. In an upward movement of the swimmer's legs the spring elastic elements 14 facilitate the inward folding of the flippers by the biassing forces such that it will not interfere with the thrust movement of the flippers.

Advantages of the present swim shoe are seen in that it provides an optimal utilization of the breast swim stroke. Thus, in the propulsion breast stroke the resisting water is divided at the edge 15 along the inner sole, whereby the water flow is diverted upwardly against the flipper 7 and laterally against the flipper 6, thus, these flippers are fully exposed to the respective resulting forces, thereby substantially increasing the propulsion efficiency of the breast stroke.

Another advantage of the present invention is seen in that even swimmers having a relatively weak breast stroke of their legs, can make good use of the present shoes because the flippers, upon reaching the maximum hinging angle, provide a rigid resistance to such an extent that even a weak propulsion breast stroke is fully utilized. On the other hand, the flippers 6 and 7 are sufficiently rigid that even the most forceful propulsion breast stroke will not result in exceeding the maximum hinging angle. Yet another advantage of the present swim shoe is seen in that it is very well suited for teaching a student the breast stroke because the water resistance is amplified by the present shoes so that the students can quickly learn a proper feel for the correct leg motions in accordance with the water resistance. Thus, the shoes cause the student to learn right from the start, a symmetric leg breast stroke.

The present swim shoes are also suitable for correcting swimming faults such as the scissor or shearing stroke. This is accomplished because the propulsion flaps are not effective when the leg stroke is faulty. Thus, the swimmer is reminded with each swim stroke whether the leg movement is correct or incorrect because he will notice the different propulsion force or effect.

The automatic back flapping of the propulsion flippers makes a walking and standing easy be it in the water or on solid ground. By removing the sole flipper 6, for example, by pulling out the hinge pin 8*a*, the present shoes can also be used as regular bath shoes. This is an advantage for older users or for apprehensive users because the danger of tripping is substantially reduced as compared to swim shoes of the prior art.

Although the best propulsion effect is achieved when both flippers are used in combination, it is possible to substantially increase the propulsion force even with one side flipper or with one sole flipper.

The present swim shoes are made of synthetic rubber, caoutchouc or elastic synthetic materials which as such are well known. Further, the particular shape is not limiting in any way whatsoever, but rather illustrative only of preferred example embodiments. Thus, other suitable configurations for the shoe body and the flippers may be used. The embodiments of FIGS. 2 and 4 may be formed from a single integral piece of elastic material. Incidentally, the flippers should preferably extend along the entire shoe length. However, shorter flippers shorter than the length of the shoe may also be utilized in accordance with the present teachings.

Flippers according to the invention have been compared with the swimming shoe disclosed in U.S. Pat. No. 3,867,734. In the comparing test the same swimmer wore once shoes according to the invention and once shoes according to the U.S. Pat. No. 3,867,734. It has been found that shoes according to said U.S. Pat. No. 3,867,734 are excellent for water treading but resulted in a consistently slower propulsion on a metered course. The measured times were slower by 16% as compared to the times achieved when wearing the present shoes. It is believed that the less efficient propulsion achievable with shoes of U.S. Pat. No. 3,867,734 is due to the fact that the prior art flippers proper cannot be hinged into a position in which the propulsion effective surface extends substantially at a right angle to the direction of a breast stroke propulsion force of a frog kick performed by the legs of the swimmer.

The present shoes have also been compared with the "Swimming Appliance" of British Pat. No. 328,519. The latter appliance is suitable for water treading only.

Although the invention has been described with reference to specific example embodiments, it will be appreciated, that it is intended to cover all modifications and equivalents within the scope of the appended claims.

What is claimed is:

1. A breast stroke swimming shoe, comprising a shoe body including upper wall means, bottom wall means forming sole means, inner side wall means, and outer side wall means, said wall means being operatively interconnected to form a foot receiving cavity, first outer propulsion flap means (6), first hinge means (8) operatively securing said first outer propulsion flap means (6) to said bottom wall means substantially alongside said outer side wall means for permitting the folding of said first outer propulsion flap means inwardly toward said sole means in response to a pull portion of a breast stroke, second inner propulsion flap means (7), and second hinge means (9) operatively securing said second inner propulsion flap means to said inner side wall means substantially alongside said upper wall means for permitting the folding of said second inner propulsion flap means downwardly toward said inner side wall means in response to said pull portion of a breast stroke and folding angle limiting means operatively arranged to limit the folding angle of said first and second propulsion flap means for permitting the simultaneous unfolding of both propulsion flap means into a propulsion effective plane in response to a push portion of a breast stroke, said folding angle limiting means being positioned for defining the fully unfolded position of said first and second propulsion flap means in which said flap means extend substantially at right angles to the direction of a breast stroke propulsion force vector exerted by the push portion of the breast stroke and wherein said outer propulsion flap means (6) extends in its rest position approximately in parallel to said sole means and in its work position approximately at a right angle to said sole means and downwardly from said sole means.

2. The breast stroke swimming shoe of claim 1, wherein said folding angle limiting means comprise an extension of said first outer propulsion flap means, said extension bearing against the respective side wall means when the respective flap means is extended as a result of a breast swim stroke.

3. The breast stroke swimming shoe of claim 1, wherein said folding angle limiting means are operatively arranged to limit the folding angle of said second inner propulsion flap means to a range of 100° to 150°.

4. The breast stroke swimming shoe of claim 3, wherein said folding angle limiting means comprise cooperating stop means contacting each other within said angle range.

5. The breast stroke swimming shoe of claim 1, wherein said first and second hinge means comprise sections of reduced thickness operatively interposed between the respective propulsion flap means and the respective wall means, said hinge means being elastic and yet sufficiently rigid so that, after any elastic deformation of the hinge means, the respective propulsion flap means will automatically return into a starting position subsequent to the completion of a breast swim stroke.

6. The breast stroke swimming shoe of claim 1, further comprising folding angle limiting means including a curved extension member (10*a*) forming an integral part of the respective flap means, said curved extension member being elastically biassed when the respective flap means is forced outwardly by a breast swim stroke, whereby the elastically biassed, curved extension member returns the respective propulsion flap means into a retracted position below said bottom wall means.

7. The breast stroke swimming shoe of claim 1, further comprising elastic connection means operatively arranged between said propulsion flap means and said wall means at points remote from said hinge means whereby the flap means are pulled back into their starting position if no further force is applied to said flap means.

8. The breast stroke swimming shoe of claim 1, further comprising an edge (15) extending on the inside along the sole means of the swimming shoe, said edge dividing and diverting the water flow upwardly and downwardly against the respective propulsion flap means.

9. The breast stroke swimming shoe of claim 8, wherein said edge (15) projects substantially in the direction of the breast stroke propulsion force vector and in front of said propulsion effective plane.

* * * * *